US010676982B1

(12) United States Patent
Harris

(10) Patent No.: US 10,676,982 B1
(45) Date of Patent: Jun. 9, 2020

(54) PROTECTIVE GARAGE DOOR COVER

(71) Applicant: Troy Harris, N. Charleston, SC (US)

(72) Inventor: Troy Harris, N. Charleston, SC (US)

( * ) Notice: Subject to any disclaimer, the term of this patent is extended or adjusted under 35 U.S.C. 154(b) by 0 days.

(21) Appl. No.: 16/404,818

(22) Filed: May 7, 2019

(51) Int. Cl.
*E06B 3/70* (2006.01)
*E05D 15/24* (2006.01)
*E06B 3/48* (2006.01)

(52) U.S. Cl.
CPC ..... *E06B 3/7001* (2013.01); *E05D 15/24* (2013.01); *E06B 3/485* (2013.01); *E05Y 2201/11* (2013.01); *E06B 2003/7044* (2013.01)

(58) Field of Classification Search
CPC ... E05D 15/24; E05Y 2201/11; E06B 3/7001; E06B 3/485; E06B 2003/7044
USPC ..... 52/3, 71, 202, 404.2, 407.4, 506.01, 52/506.06, 784.1, 784.15; 160/133, 201, 160/229.1, 236, 405, 408, 506.01, 506.05, 160/547, 582.1, 741.4, 745.21
See application file for complete search history.

(56) References Cited

U.S. PATENT DOCUMENTS 4,712,598 A * 12/1987 Bonacci ..... E06B 9/262 160/327
5,358,025 A * 10/1994 Wood ..... E06B 9/00 160/368.1
5,649,390 A * 7/1997 Davidson ..... B44C 5/00 160/179
5,839,237 A * 11/1998 Davidson ..... E06B 3/7001 52/3
5,937,587 A * 8/1999 Zinbarg ..... E06B 3/7001 52/222
5,946,869 A * 9/1999 Zinbarg ..... E06B 3/485 160/179
6,035,919 A * 3/2000 Zinbarg ..... E06B 3/485 160/113
6,059,005 A * 5/2000 Zinbarg ..... E06B 3/7001 160/329
6,157,023 A 12/2000 Wenner
6,395,369 B1 * 5/2002 Randone ..... B32B 5/26 160/10
6,572,238 B1 * 6/2003 Johnson ..... B44C 5/04 362/145
6,945,300 B2 * 9/2005 Smith ..... E06B 9/13 160/329
D511,839 S 11/2005 Dixon
8,590,244 B2 * 11/2013 O'Riordan ..... E06B 3/485 160/229.1
8,851,145 B2 * 10/2014 O'Riordan ..... E06B 3/485 160/216

(Continued)

FOREIGN PATENT DOCUMENTS

GB 2470183 11/2010

*Primary Examiner* — Brian E Glessner
*Assistant Examiner* — Adam G Barlow
(74) *Attorney, Agent, or Firm* — Kyle A. Fletcher, Esq.

(57) ABSTRACT

The protective garage door cover comprises a composite textile, a plurality of fasteners, and a garage door. The garage door further comprises a plurality of door panels. The plurality of fasteners attach the composite textile to the garage door. The protective garage door cover forms a protective cover over the garage door. The protective garage door forms an insulating structure that insulates the garage door. The composite textile is a flexible structure such that the composite textile will bend with the garage door as the garage door is opened and closed.

13 Claims, 4 Drawing Sheets

(56) References Cited

U.S. PATENT DOCUMENTS

| | | | | |
|---|---|---|---|---|
| 9,163,451 | B1 * | 10/2015 | Curry | E06B 9/24 |
| 2006/0027344 | A1 * | 2/2006 | Lampe | G09F 19/22 160/209 |
| 2009/0199501 | A1 * | 8/2009 | O'Riordan | E06B 3/485 52/455 |
| 2010/0108210 | A1 | 5/2010 | Garcia | |
| 2012/0241107 | A1 * | 9/2012 | Gontarski | B29C 65/5028 160/236 |
| 2013/0061522 | A1 | 3/2013 | Alexander | |
| 2018/0266172 | A1 * | 9/2018 | Wray | E06B 7/20 |
| 2019/0203524 | A1 * | 7/2019 | Nero | E06B 3/485 |

* cited by examiner

PROTECTIVE GARAGE DOOR COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of buildings including movable closures, more specifically, a covering for the door leaf of a garage door. (E06B3/7044)

SUMMARY OF INVENTION

The protective garage door cover comprises a composite textile, a plurality of fasteners, and a garage door. The garage door further comprises a plurality of door panels. The plurality of fasteners attach the composite textile to the garage door. The protective garage door cover forms a protective cover over the garage door. The protective garage door forms an insulating structure that insulates the garage door. The composite textile is a flexible structure such that the composite textile will bend with the garage door as the garage door is opened and closed.

These together with additional objects, features and advantages of the protective garage door cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the protective garage door cover in detail, it is to be understood that the protective garage door cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the protective garage door cover.

It is therefore important that the claims be regarded as including such equivalent construction insofar as they do not depart from the spirit and scope of the protective garage door cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
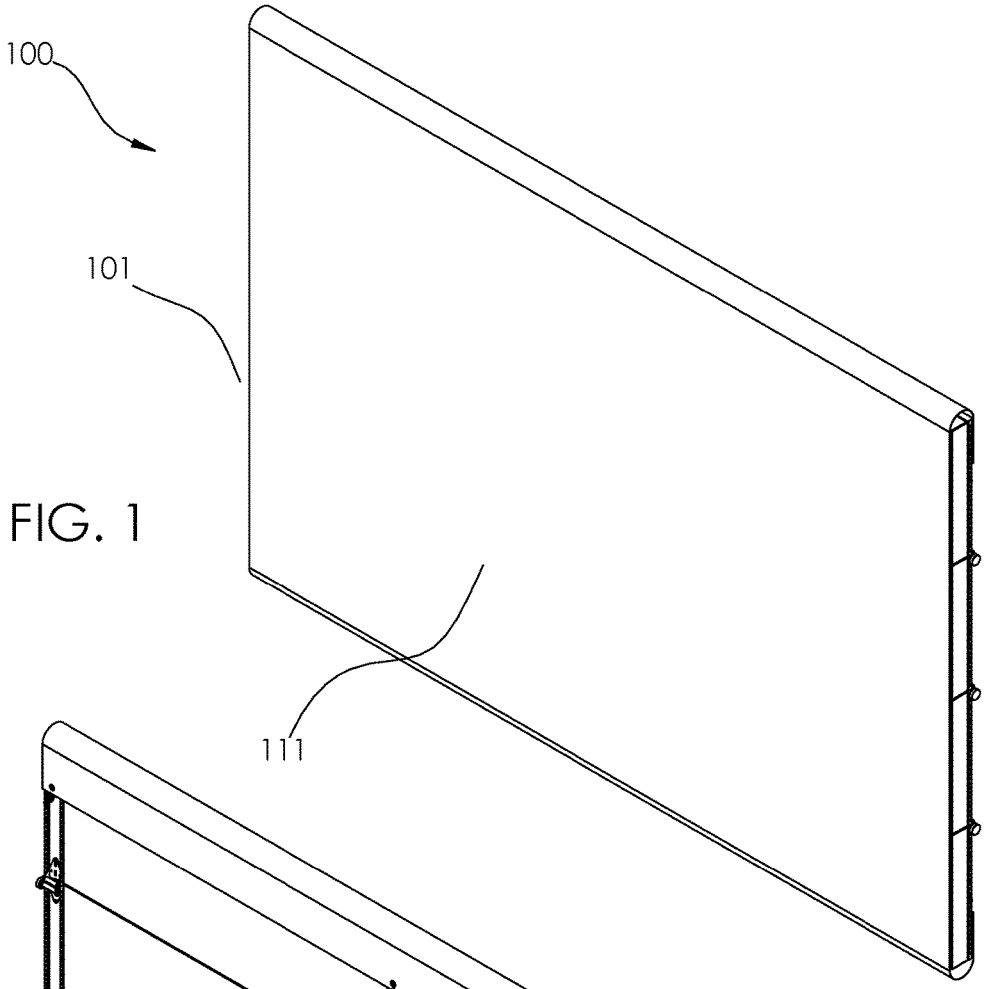
FIG. 1 is a perspective view of an embodiment of the disclosure.
Figure 2:
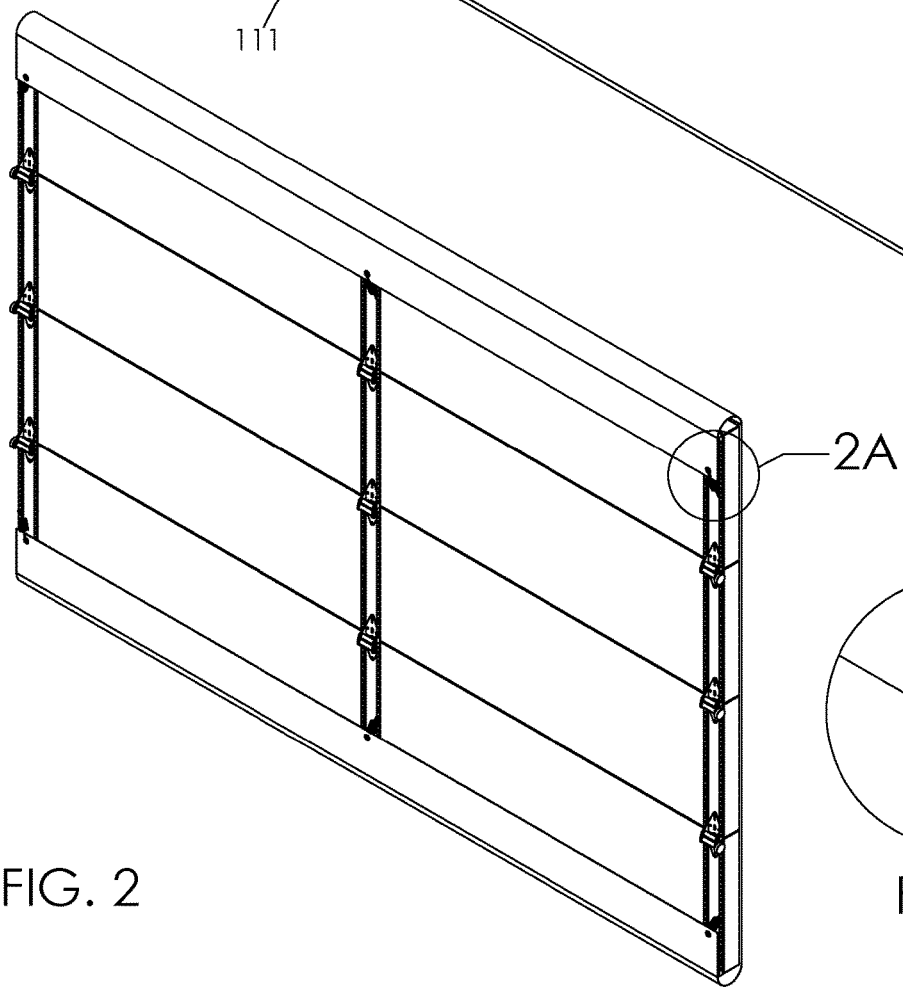
FIG. 2 is a reverse, perspective view of an embodiment of the disclosure.
Figure 2A:
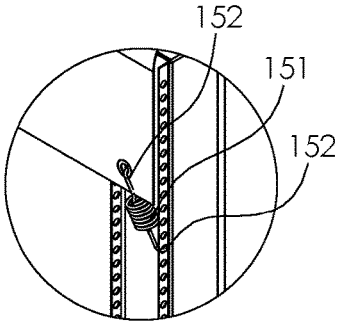
FIG. 2*a* is a detail view of an embodiment of the disclosure.
Figure 3:
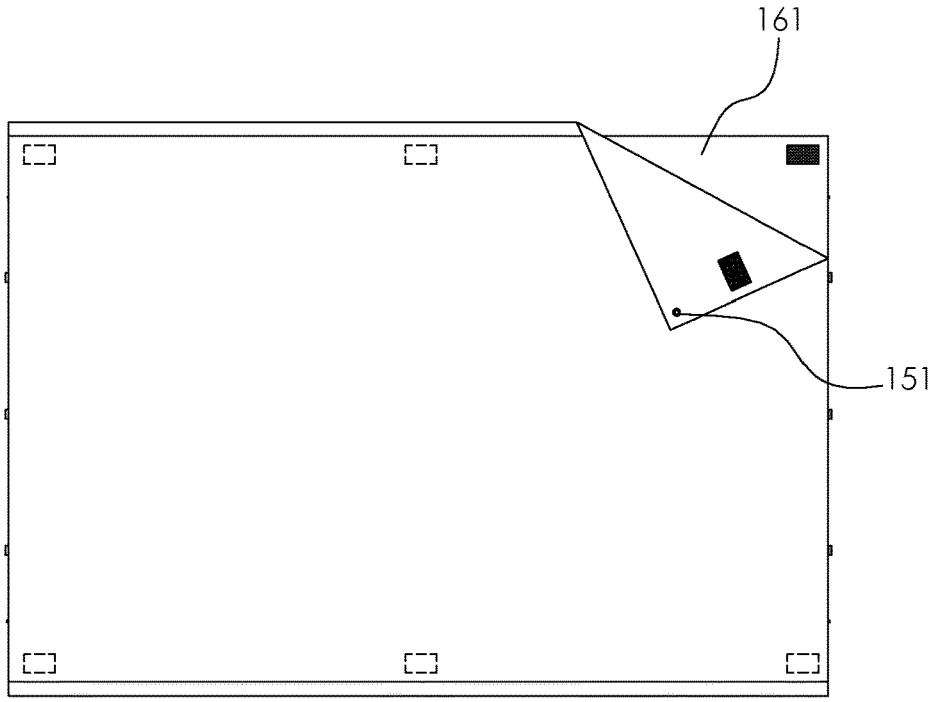
FIG. 3 is a front view of an embodiment of the disclosure.
Figure 4:
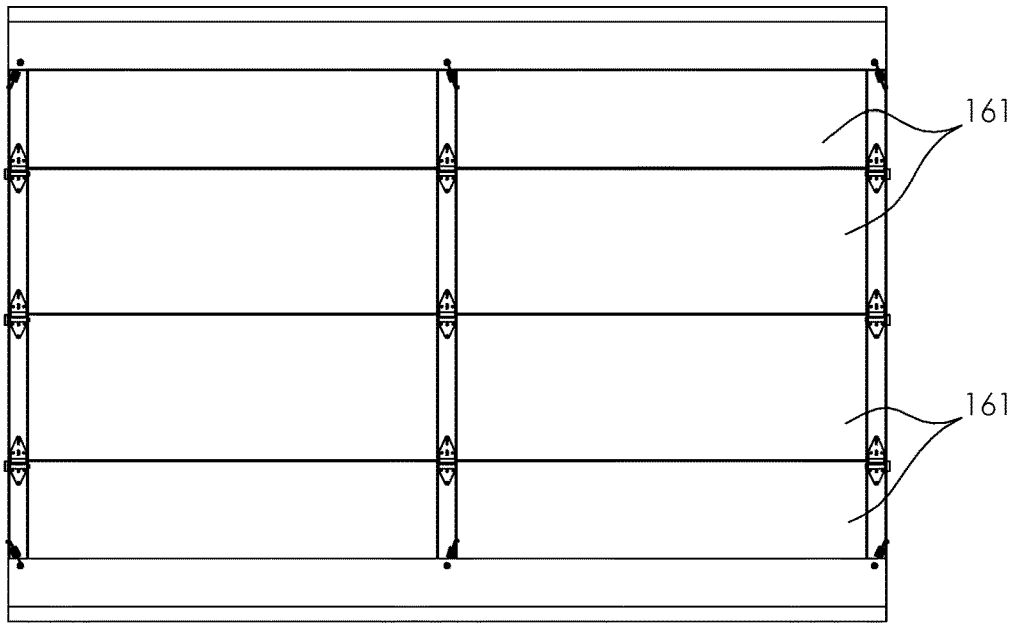
FIG. 4 is a rear in-use view of an embodiment of the disclosure.
Figure 5:
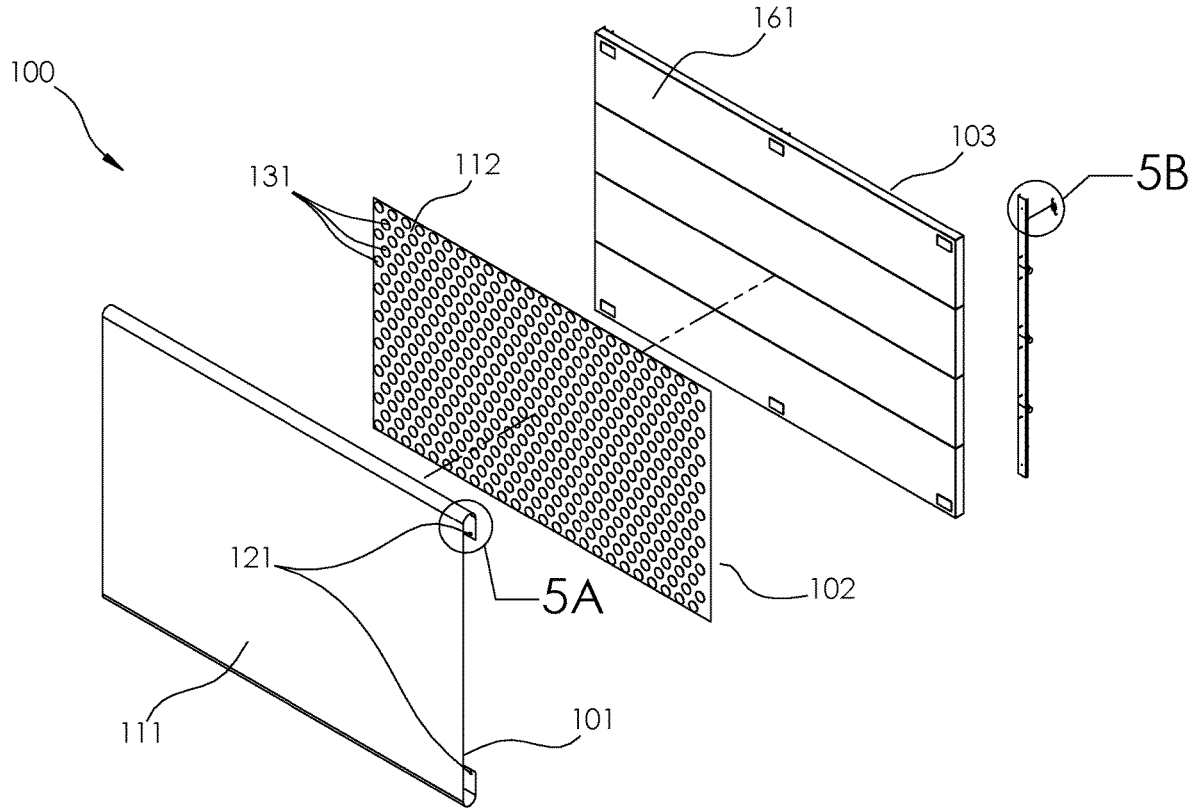
FIG. 5 is an exploded view of an embodiment of the disclosure.
Figure 5A:
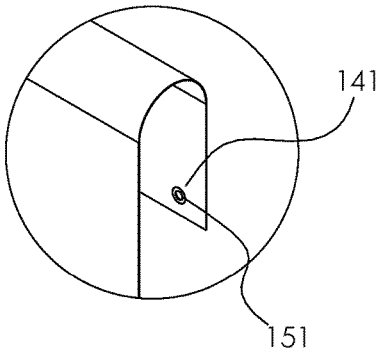
FIG. 5*a* is a detail view of an embodiment of the disclosure.
Figure 5B:
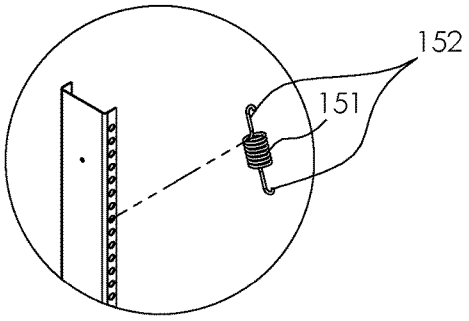
FIG. 5*b* is a detail view of an embodiment of the disclosure.
Figure 6:
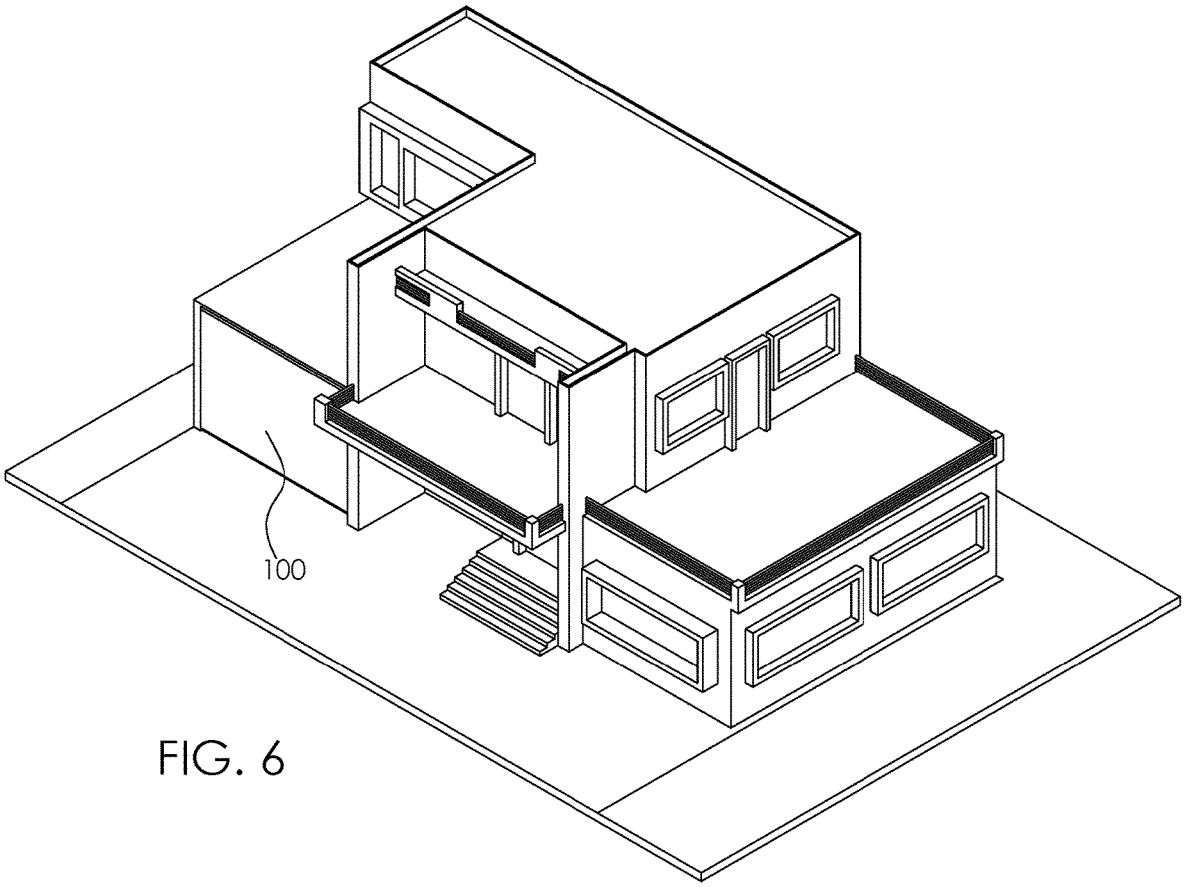
FIG. 6 is an in-use view of an embodiment of the disclosure.
Figure 7:
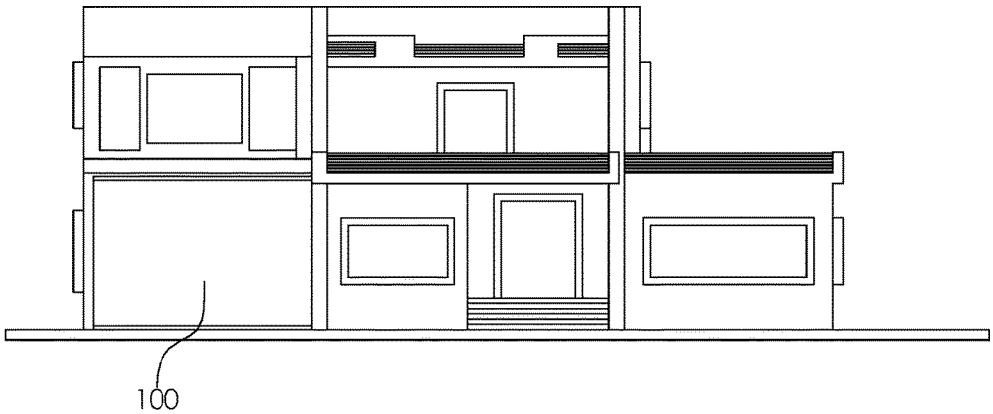
FIG. 7 is an in-use view of an embodiment of the disclosure.

Detailed reference will now be made to one or more potential embodiments of the disclosure, which are illustrated in FIGS. 1 through 7.

The protective garage door cover 100 (hereinafter invention) comprises a composite textile 101, a plurality of fasteners 102, and a garage door 103. The garage door 103 further comprises a plurality of door panels 161. The plurality of fasteners 102 attach the composite textile 101 to the garage door 103. The invention 100 forms a protective cover over the garage door 103. The invention 100 forms an insulating structure that insulates the garage door 103. The composite textile 101 is a flexible structure such that the composite textile 101 will bend with the plurality of door panels 161 of the garage door 103 as the garage door 103 opens and closes. The invention 100 mounts on the exterior surface of the garage door 103.

The composite textile 101 has a composite textile 101 structure. The composite textile 101 mounts on the exterior surface of the garage door 103. The composite textile 101 is a flexible structure that bends with the plurality of door panels 161 of the garage door 103 as the garage door 103 opens and closes. The composite textile 101 protects the garage door 103. The composite textile 101 insulates the garage door 103. The composite textile 101 comprises an exterior sheeting structure 111 and an insulating sheeting structure 112.

The exterior sheeting structure 111 is a vinyl sheeting. The exterior sheeting structure 111 is cut in a rectangular shape. The exterior sheeting structure 111 forms the exterior surface of the invention 100 when the invention 100 mounts on the garage door 103. The exterior sheeting structure 111 is formed as vinyl-based plastic sheeting. The exterior sheeting structure 111 protects the garage door 103 from damage. The exterior sheeting structure 111 further comprises a first plurality of eyelets 121.

The first plurality of eyelets 121 comprises a plurality of apertures that are formed through the exterior sheeting structure 111. The first plurality of eyelets 121 are positioned in the vertexes of the exterior sheeting structure 111. A fastener selected from the plurality of fasteners 102 attaches an eyelet selected from the first plurality of eyelets 121 attaches the composite textile 101 to the garage door 103.

The first plurality of eyelets 121 further comprises a first plurality of grommets 141. Each of the first plurality of grommets 141 is a grommet. There is a one to one correspondence between the first plurality of grommets 141 and the first plurality of eyelets 121. Each grommet selected from the first plurality of grommets 141 inserts into its associated eyelet such that the selected grommet will protect the exterior sheeting structure 111 in the vicinity of the associated eyelet.

The insulating sheeting structure 112 is a sheeting structure. The insulating sheeting structure 112 is cut in a rectangular shape that is geometrically identical to the exterior sheeting structure 111. The insulating sheeting structure 112 attaches to the exterior sheeting structure 111 to form the basic structure of the composite textile 101. Methods to layer sheetings to form a composite textile 101 are well-known and documented in the mechanical arts. The insulating sheeting structure 112 forms the interior surface of the invention 100 when the invention 100 mounts on the garage door 103. The insulating sheeting structure 112 is formed from an insulating material. The insulating sheeting structure 112 insulates the garage door 103. The insulating sheeting structure 112 further comprises a plurality of offset structures 131.

Each of the plurality of offset structures 131 is a sealed gas-filled pocket that is formed on the surface of the insulating sheeting structure 112 that is proximal to the exterior sheeting structure 111. The plurality of offset structures 131 forms a cushion that protects the garage door 103 from impact damage. The plurality of offset structures 131 separates the exterior sheeting structure 111 from the insulating sheeting structure 112. The plurality of offset structures 131 forms an insulating structure that inhibits thermal transfer through the invention 100. The plurality of offset structures 131 further forms a cushioning structure that protects the garage door 103 from impact damage.

Each of the plurality of fasteners 102 is a commercially available fastening device. Each of the plurality of fasteners 102 is a spring-based hardware item. The plurality of fasteners 102 attach the composite textile 101 to the garage door 103. The use of a plurality of fasteners 102 for this purpose is well-known and documented in the mechanical arts. In the first potential embodiment of the disclosure, each of the plurality of fasteners 102 comprises a helical coil spring 151. Each end of the helical coil spring has a hook attached to it.

The following definitions were used in this disclosure:

Bladder: As used in this disclosure, a bladder is gas impermeable structure. The internal volume of the structure can be varied by: varying the pressure and/or quantity of a gas contained within the bladder; or 2) varying the quantity of a liquid contained within the bladder. Bladders are commonly used for storage of a gas or liquid and as a cushion.

Composite Textile: As used in this disclosure, a composite textile is a multilayer fabric made of two or more joined layers of textile or sheeting materials.

Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Door: As used in this disclosure, a door is a movable or removable barrier that is attached to the wall of a room or the surface of a container for the purpose of allowing or preventing access through an aperture into the room or container.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Flexible: As used in this disclosure, flexible refers to an object or material that will deform when a force is applied to it but that will not necessarily return to its original shape when the deforming force is removed.

Fluid: As used in this disclosure, a fluid refers to a state of matter wherein the matter is capable of flow and takes the shape of a container it is placed within. The term fluid commonly refers to a liquid or a gas.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grommet: As used in this disclosure, a grommet is an eyelet placed in a hole in a textile, sheet, or panel that protects a rope hook or cable passed through it and to protect the textile, sheet, or panel from being torn. See bushing.

Hardware: As used in this disclosure, refers to one or more incidental objects: 1) that are readily and commercially available; and, 2) that are associated with the installation, operation or maintenance of a primary object. Always use incidental.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Hook: As used in this disclosure, a hook is an object that is curved or bent at an angle such that items can be hung on or caught by the object.

Impact: As used in this disclosure, an impact refers to a rapid exchange of momentum between two objects. An impact often refers to a collision between two objects.

Incidental: As used in this disclosure, incidental refers to a second object that is associated with a first object but that: 1) does not significantly affect the characteristics of the first object; and, 2) the function of which can be readily replaced by or substituted with a third object.

Insulating Material: As used in this disclosure, an insulating material is a structure that inhibits, and ideally prevents, the transfer of heat through the insulating material. Insulating materials may also be used to inhibit or prevent the transfer of sound or the conduction of electricity through the insulating material. Methods to form insulating materials include, but are not limited to: 1) the use of materials with low thermal conductivity; and, 2) the use of a structural design that places a vacuum within the insulating material within the anticipated transfer path of the heat, sound, or electric current flow.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Liquid: As used in this disclosure, a liquid refers to a state (phase) of matter that is fluid and that maintains, for a given pressure, a fixed volume that is independent of the volume of the container.

Monomer: As used in this disclosure, a monomer refers to a molecular structure that bonds to itself in a repeating manner to form a polymer.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Plastic: As used in this disclosure, plastic refers to a manufactured material that is formed from a structure selected from the group consisting of a polymer or a copolymer. Unless stated otherwise, this disclosure assumes that the plastic is formed from organic monomers.

Polymer: As used in this disclosure, a polymer refers to a molecular chain that comprises multiple repeating units known as monomers. The repeating unit may be an atom or a molecular structure.

Organic: As used in this disclosure, organic refers to a carbon-based chemical structure. A limited number of carbon-based salts are traditionally considered inorganic chemical structures and are excluded from the study of organic chemistry.

Screw: As used in this disclosure, to screw is a verb meaning: 1) to fasten or unfasten (unscrew) a threaded connection; or 2) to attach a helical structure to a solid structure.

Sheeting: As used in this disclosure, a sheeting is a material, such as a textile, a plastic, or a metal foil, in the form of a thin flexible layer or layers.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Tension Spring: As used in this disclosure, a tension spring, also commonly referred to as an extension spring and a helical coil spring, is a wire coil that resists forces attempting to pull the wire coil in the direction of the center axis of the wire coil. The tension spring will return to its original position when the pulling force is removed.

Textile: As used in this disclosure, a textile is a material that is woven, knitted, braided or felted. Synonyms in common usage for this definition include fabric and cloth.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Vertex: As used in this disclosure, a vertex (plural vertices) is an angle that is formed by two lines that form a point. Vertices are commonly found in polygons.

Vinyl: As used in this disclosure, a vinyl refers to a chemical structure with a form RHC═CH2. In this structure, the R refers to a chemical substance including, but not limited to, a functional group, a halide, and a hydrogen atom. A polymer is often formed from vinyl monomers by breaking the double bond between the carbon atoms in a manner that forms a chain of vinyl monomers linked by single bonded carbon atoms.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A door covering comprising:

a composite textile, a plurality of fasteners, and a garage door;

wherein the plurality of fasteners attach the composite textile to the garage door;

wherein the garage door further comprises a plurality of door panels;

wherein the door covering forms a protective cover over the garage door;

wherein the door covering forms an insulating structure that insulates the garage door;

wherein the composite textile is a flexible structure such that the composite textile bends with the plurality of door panels of the garage door as the garage door opens and closes;

wherein the composite textile comprises an exterior sheeting structure and an insulating sheeting structure;

wherein the exterior sheeting structure attaches to the insulating sheeting structure;

wherein the composite textile protects the garage door;

wherein the composite textile insulates the garage door;

wherein the exterior sheeting structure further comprises a first plurality of eyelets;

wherein the first plurality of eyelets comprises a plurality of apertures that are formed through the exterior sheeting structure;

wherein the first plurality of eyelets are positioned at a vertex of the exterior sheeting structure;

wherein a fastener selected from the plurality of fasteners inserts through an eyelet selected from the first plurality of eyelets.

2. The door covering according to claim 1 wherein the door covering mounts on the exterior surface of the garage door.

3. The door covering according to claim 1 wherein each of the plurality of fasteners are assembled from hardware.

4. The door covering according to claim 3 wherein the plurality of fasteners comprises a helical coil spring;

wherein each end of the helical coil spring has a hook attached to it.

5. The door covering according to claim 4 wherein the plurality of fasteners secures the exterior sheeting structure and the insulating sheeting structure to the garage door.

6. The door covering according to claim 5 wherein the exterior sheeting structure comprises a plastic sheeting;

wherein the exterior sheeting structure is cut in a rectangular shape.

7. The door covering according to claim 6 wherein the exterior sheeting structure forms the exterior surface of the door covering when the door covering mounts on the garage door.

8. The door covering according to claim 7 wherein the exterior sheeting structure is formed from vinyl-based plastic.

9. The door covering according to claim 8 wherein the first plurality of eyelets further comprises a first plurality of grommets;

wherein there is a one to one correspondence between the first plurality of grommets and the first plurality of eyelets;

wherein each grommet selected from the first plurality of grommets inserts into its associated eyelet.

10. The door covering according to claim 9 wherein the insulating sheeting structure is a sheeting structure;

wherein the insulating sheeting structure is cut in a rectangular shape that is geometrically identical to the exterior sheeting structure;

wherein the insulating sheeting structure attaches to the exterior sheeting structure;

wherein the insulating sheeting structure forms the interior surface of the door covering when the door covering mounts on the garage door.

11. The door covering according to claim 10 wherein the insulating sheeting structure is formed from an insulating material.

12. The door covering according to claim 11 wherein the insulating sheeting structure further comprises a plurality of offset structures;

wherein the plurality of offset structures attach to the insulating sheeting structure.

13. The door covering according to claim 12 wherein each of the plurality of offset structures is a sealed gas-filled pocket;

wherein each of the plurality of offset structures are formed on the surface of the insulating sheeting structure that is proximal to the exterior sheeting structure.

* * * * *